US005381609A

United States Patent [19]

Hieblinger

[11] Patent Number: 5,381,609

[45] Date of Patent: Jan. 17, 1995

[54] SHOE WITH CENTRAL CLOSURE

[75] Inventor: Rudolf Hieblinger, Munich, Germany

[73] Assignee: Tretorn AB, Helsingborg, Sweden

[21] Appl. No.: 144,443

[22] Filed: Nov. 2, 1993

[30] Foreign Application Priority Data

Nov. 2, 1992 [DE] Germany ..... 9214848

[51] Int. Cl.[6] ..... A43B 11/00; A43B 5/04

[52] U.S. Cl. ..... 36/50.1; 36/119

[58] Field of Search ..... 36/114, 119, 50.1, 50.5, 36/88, 170, 69, 105, 54

[56] References Cited

U.S. PATENT DOCUMENTS

| | | | |
|---|---|---|---|
| 4,190,970 | 3/1980 | Annovi | 36/50.5 |
| 4,736,531 | 4/1988 | Richard | 36/114 |
| 4,811,503 | 3/1989 | Iwama | 36/50.5 X |
| 4,924,605 | 5/1990 | Spademan | 36/88 X |
| 4,937,952 | 7/1990 | Olivieri | 36/50.5 X |
| 4,972,617 | 11/1990 | Loveder | 36/105 |
| 5,117,567 | 6/1992 | Berger | 36/50 |
| 5,177,882 | 1/1993 | Berger | 36/50.1 |
| 5,181,331 | 1/1993 | Berger | 36/50.1 |
| 5,291,671 | 3/1994 | Gaberlotto et al. | 36/50.1 X |

FOREIGN PATENT DOCUMENTS

| | | |
|---|---|---|
| 385639 | 10/1987 | Australia . |
| 0099504 | 4/1983 | European Pat. Off. . |
| 0132744 | 7/1984 | European Pat. Off. . |
| 393380 | 3/1990 | European Pat. Off. . |
| 3524792 | 1/1986 | Germany . |

*Primary Examiner*—Paul T. Sewell
*Assistant Examiner*—BethAnne C. Cicconi
*Attorney, Agent, or Firm*—Sixbey, Friedman, Leedom & Ferguson

[57] ABSTRACT

A shoe of the type having a sole and an upper formed of nonrigid materials attached to the sole, and with a central closure mechanism that is coupled with at least one elongated flexible tightening element by which a vamp of the upper can be tightened and loosened via increasing and decreasing an effective length of the at least one tightening element as measured from the central closure mechanism as it runs between guide elements on the upper and on an instep shield. In accordance with preferred embodiments, the shoe upper has a closed vamp, at least the instep area of which is formed of a volume-elastic compressible material and the instep cover is formed of an elastically bendable material at least approximately matched to the surface contour at least a portion of the instep. Additionally, the central closure is provided on the outside of the back of the upper above the heel, and the tightening element runs from the central closure along both sides of the shoe, via a guide element provided curving around the heel from near the height of the insole, without crossing the instep, to a higher guide element provided on the instep cover and then to a forward guide element lying at the level of the insole on the outside of the shoe upper near the small toe at the medial side of the shoe and in the area between the metatarsophalangeal joint of the big toe and approximately the center of the arch on the lateral side of the shoe.

20 Claims, 4 Drawing Sheets

SHOE WITH CENTRAL CLOSURE

BACKGROUND OF THE INVENTION

1. Field of the Invention

This invention relates to a shoe, especially sport or leisure shoe, with a central closure that is coupled with at least one rope-like tightening element, with can be shortened to tighten the vamp area of the shoe and lengthened to loosen it, the tightening element being guided back and forth between guide elements on side parts of the upper and on an instep cover that overlies the instep area.

2. Description of Related Art

A shoe of the general type to which this invention is directed is known, in the form of a ski boot, for example, from EP B1 0 099 504 and EP B1 0 132 744. In the case of these ski boots, a central closure is provided on the upper rear part of a boot upper that, as is generally known, is made of a relatively rigid material. A cover that extends over the instep area and the ankle to the attachment point of the shin-bone is present. This cover is, therefore, shaped angularly when viewed from the side. From the central closure, a tightening element extends on both sides approximately from the sole area in the area of the ankle over the cover. The cover also is made of a relatively rigid material and is used to tightly hold the foot in the shoe, and it is located in the shoe between a soft inner shoe and the rigid outer shell.

Further, it is known from German application DE A 35 24 792 to provide, in the case of a ski boot, a bending cuff made of rigid material on the front upper part, a cuff that is hinged to pivot on the upper in the area of the ankle bone and extends upward to over the center of the shin-bone. In the upper end area, ends of the tightening element are laterally fastened to the bending cuff and are coupled with a central sliding closure located on the upper rear part. The bending cuff can therefore be pulled against the upper in the shin-bone area.

Also known (U.S. Pat. Nos. 5, 117,567; 5,177,882 and 5,181,331) are athletic shoes which have an upper formed of nonrigid materials that are provided with a central closure mechanism that is coupled with at least one elongated flexible tightening element by which a vamp of the upper can be tightened and loosened via increasing and decreasing an effective length of the at least one tightening element as measured from the central closure mechanism, the at least one tightening element being guided from the central closure mechanism along sides of the shoe so as pass between guide elements on the upper and an instep cover that at least partially overlaps an instep area of the shoe. However, in these shoes, the central closure is mounted on the instep cover and the vamp has a throat opening in the instep area that is covered by the instep cover and the guide elements on the upper are disposed at the sides of the throat opening.

SUMMARY OF THE INVENTION

A primary object of this invention is to provide a shoe, which does not have a hard outer shell, with a central closure on the rear side of the upper.

Another object of rite invention is to provide a shoe in accordance with the foregoing object in which the closing mechanism is designed so that the elastic properties of the shoe upper are impaired as little as possible.

These objects and others are achieved in accordance with the present invention by preferred embodiments having the following features:

- the shoe upper has a closed vamp that, at least in the instep area is formed of a volume-elastic compressible material;
- the instep cover is formed of an elastically bendable material at least approximately matched to the surface contour at at least a portion of the instep;
- the central closure is provided on the outside of the back of the upper above the heel; and
- the tightening element or a tightening element section runs from the central closure along both sides of the shoe, via a guide element provided curving around the heel from near the height of the insole, without crossing the instep to a higher guide element provided on a side of the instep cover and then to a forward guide element lying at the level of the insole on the outside of the shoe upper in an area extending near the small toe at the medial side of the shoe and in the area between the metatarsophalangeal joint of the big toe and approximately the center of the arch on the lateral side of the shoe, by which the instep cover can be tightened in the direction of sole of the shoe.

It is assured by this invention that the instep cover is tightened on both sides of the shoe by being drawn down toward the sole. By these measures and by the use of an elastically bendable instep cover, a favorable distribution of pressure over the instep is achieved, since the instep cover can be easily matched to the shape of the instep. Further, the additional advantage is produced that no tightening element and no closure part extends across the instep, so that the danger of a local pressure overload does not exist.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENTS

Figure 1:
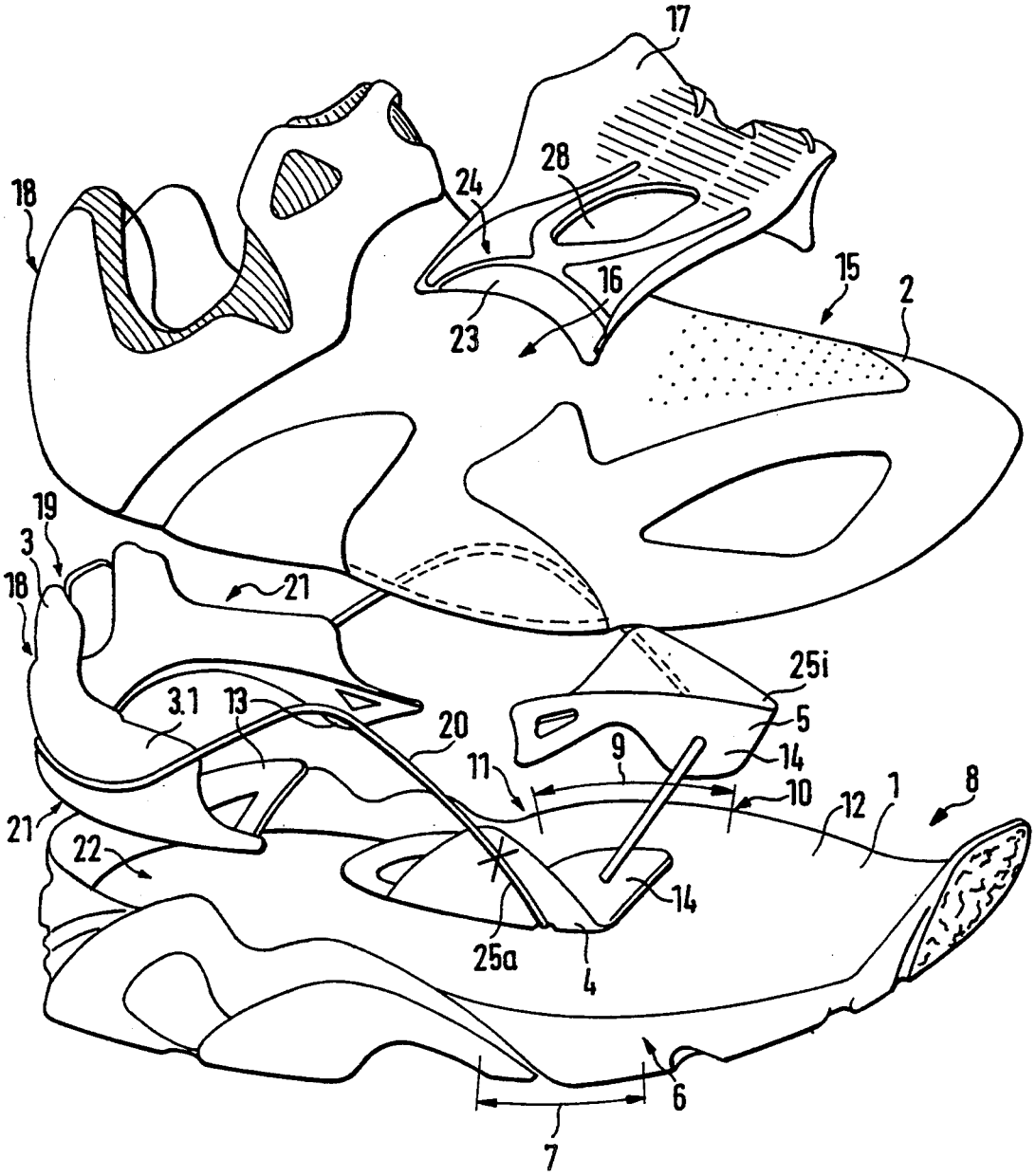
FIGS. 1 and 2 are explode perspective views of two shoes according to preferred embodiments of the invention.

In FIG. 1, an athletic shoe is shown of the type used, for example, as a running shoe. This shoe has a sole element 1 and an upper 2, which is fastened to the sole element 1 with a heel cap (counter) 3 and two lateral guide elements 4 and 5 secured therebetween. Guide element 4 is attached on the lateral (outer side) 6 of the shoe in a small toe area 7, and the guide element 5 is attached on the medial (inner side) 8 of the shoe in an area 9 between the location of the metatarsophalangeal joint 10 of the big toe and approximately the center of arch 11 of the wearer.

Preferably, the heel cap 3 is provided with a flange, or several flange sections, 13 which projects inwardly so as to run along sole surface 12 to achieve a good anchoring of the heel cap 3 in the shoe between sole element 1 (which is formed, for example by a wearresistant outer sole and a shock absorbing midsole layer) and an insole to be provided on this surface 12 (not shown). The insole can, for example, be formed as part of a structural unit with the upper 2. For the same purpose, guide elements 4 and 5 can each have a flange-like strap 14 that runs inwardly along sole surface 12.

The shoe upper 2 has a, preferably, closed vamp 15 and is overlapped in the area of instep 16 by a relatively wide, laterally downwardly extending instep cover 17. The shoe upper is formed, at least in the area of instep 16, of a volume-elastic compressible material. For this purpose, plastic foams, such as, in particular, the foam materials known under the trademark "Neoprene" or based on it, or foams made of polyethylene, polyamide or materials having similar properties are especially suitable. Instep cover 17 is made of an elastically bendable and preferably also at least slightly stretchable material. For example, this elastically bendable and stretchable material may be a suitable elastomer that, in addition, can be bonded on a fabric. Instep cover 17 should be matched at least approximately to the shape of the instep, even if it does not have to cover it completely. Also, instep cover 17 can, basically, be formed of a foamed material or can have a layer foamed in such a way that the degree of foaming of the instep cover is kept smaller, however, than that of instep 16 of the upper lying underneath it.

In the assembled state, a central closure 19 (the center part of the heel in FIG. 1 diagrammatically shows only the position of this central closure) is placed on rear side 18 of the upper exterior in the area above the heel. The central closure 19 is coupled to at least one rope-like tightening element 20. This tightening element 20 runs from central closure 19, on both sides 6, 8 of the shoe, around the heel along heel curve 21, for example, in a guide groove 3.1 in heel cap 3 to level area 22 of the insole to be inserted. Tightening element 20 runs from the heel cap 3, without crossing instep 16, along a guide element 24 designed, for example, as a guide groove and located on a higher level on each lateral end section 23 of instep cover 17, to either a point of attachment provided on guide element 4 or 5 (indicated by an X) or to a respective deflecting element **25*a*, 25*i* of the guide element 4, 5 where the tightening element 20 is turned inwardly approximately at the level of the insole and guided through across the sole of the shoe to the respective other side of the shoe, for example, between sole part 1 and the insole or a midsole disposed thereon. The lateral side deflecting element 25*a* is located in the small toe area 7 while the medial side deflecting element 25*i* is provided in the area between metatarsophalangeal joint 10 of the big toe and approximately the center of arch 11**.

By these structural measures, instep cover 17 can be pulled or tightened downwardly toward the sole, when the effective length of tightening element 20 is shortened by the closing part of central closure 19. As a result, the instep cover 17 presses on the instep by compressing the upper material in the instep area in a large area and thus with lower surface stress. Therefore, a better and more secure holding of the foot in the shoe is achieved without producing pressure points. Also, the entire upper instep area of the shoe can be provided with a surface that is completely smooth and free of any disturbing projections.

As already mentioned, central closure 19 is either attached to the rear side of heel cap 3 or to rear side 18 of the upper lying above it, and heel cap 3 comprises guide elements 3.1 for tightening element 20.

In small toe area 7 and in area 9 between metatarsophalangeal joint 10 of the big toe and approximately the center of arch 11, in each case guide element 4, 5 is provided with a strap 14 running across the sole and with a an upstanding section on the side of upper 2, to which tightening element 20 is attachable or over which it is guided and deflected. In the case illustrated in FIG. 1, the tightening element passes along a guide groove on the exterior side of the upstanding section and through an aperture at its base into a guide groove on the top side of the flange-like strap 14. It is also possible to have the tightening element 20 run from the lateral side 6 to the medial side 8 within the sole 1 of the shoe, or it can run between the insole and sole 1.

Instead of said guide grooves, heel cap 3 and guide elements 4, 5 can also be provided with guide openings for tightening element 20. Also, heel cap 3 can have either an inward-projecting flange 13 running in the plane of the sole, or several such flange sections. Straps 14 of guide elements 4, 5 and flange 13 or the flange sections of heel cap 3 are preferably embedded between the sole 1 and the insole.

Figure 2:
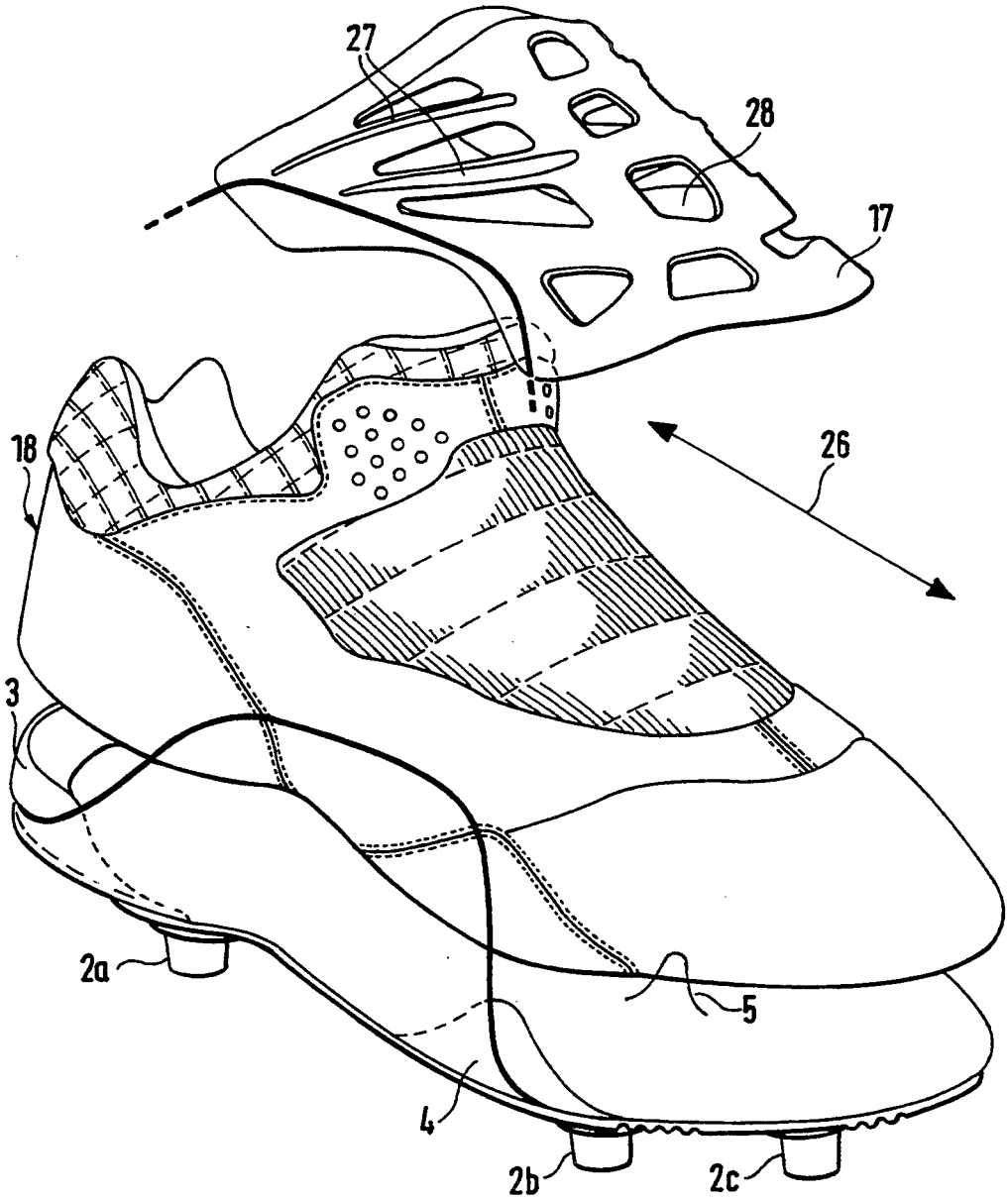

In the embodiment represented in FIG. 2, a cleated athletic shoe of the type used, e.g., for football, soccer, softball, etc., is shown. In this case, the heel cap 3 and guide elements 4, 5 are formed as part of a sole part made of elastically springy material, such as plastic, for example, polyethylene, polyamide or the like and are produced, for example, with this sole part as a single molded part, such as an injection molded part. This type of production is suitable in the case of the noted type of cleated athletic shoe, or any other that is provided with an outer sole made of a relatively rigid, abrasion-resistant material. Only some of the cleat-type gripping elements provided are shown, being designated **2*a*, 2*b*, 2*c***, and it should be recognized that the number, type and location of such gripping elements, itself, forms no part of this invention.

The instep cover 17 represented in FIG. 2 is provided with stiffening elements 27, for example stiffening ribs, running crosswise, thus, for example, perpendicular or at an angle to longitudinal axis 26 of the shoe. In addition, instep cover 17, as also is shown in FIG. 2, can be provided with openings and/or indentations 28.

Figure 3:
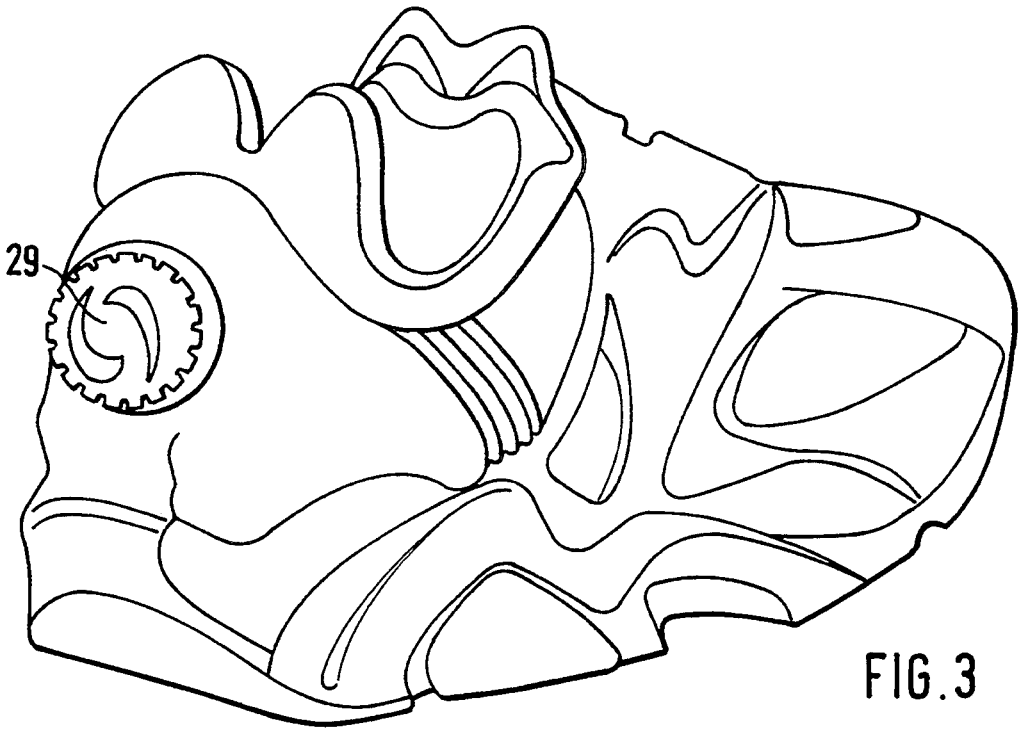
FIGS. 3 to 6 each is a perspective rear view of a different central closure for shoes in accordance with either of FIGS. 1 & 2.

As a central closure, a central rotary closure 29, according to Fig. 3, can be provided on rear side 18 of the upper. Preferably, this central rotary closure 29, as is known in the art, has a possibility for quick release.

Figure 4:
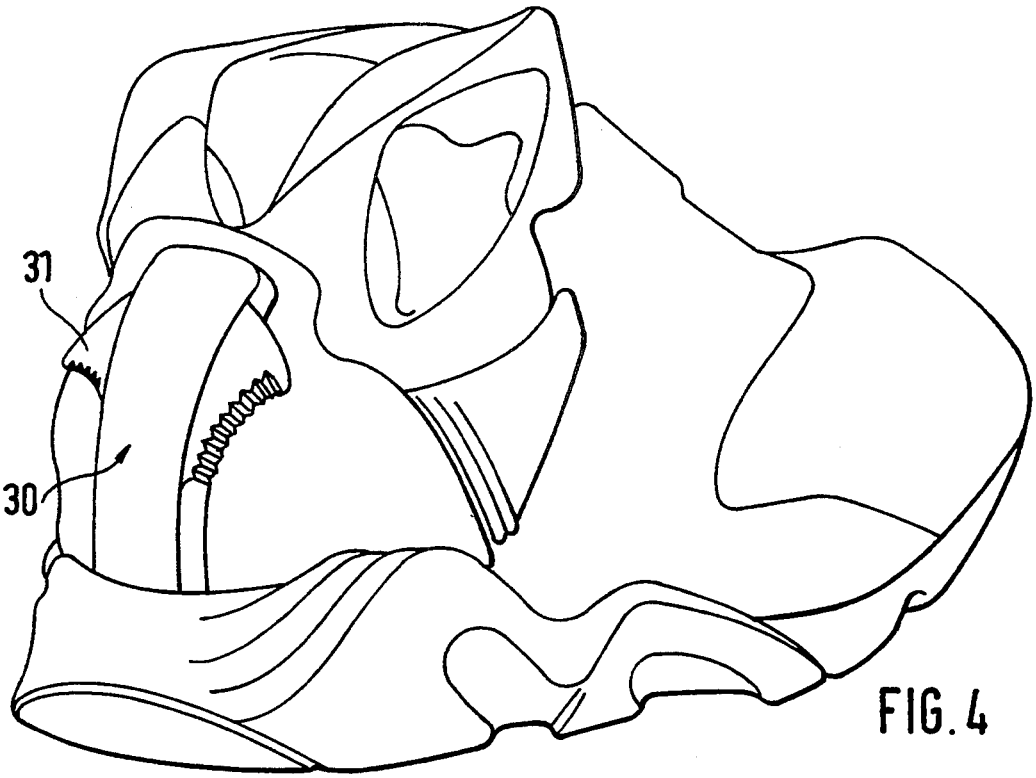

When the central closure is embodied as a known central sliding closure 30, a lateral actuating means 31, according to FIG. 4, can be attached that engages in a lateral toothing of the slide, by which a quick release can, for example, be performed.

Figure 5:
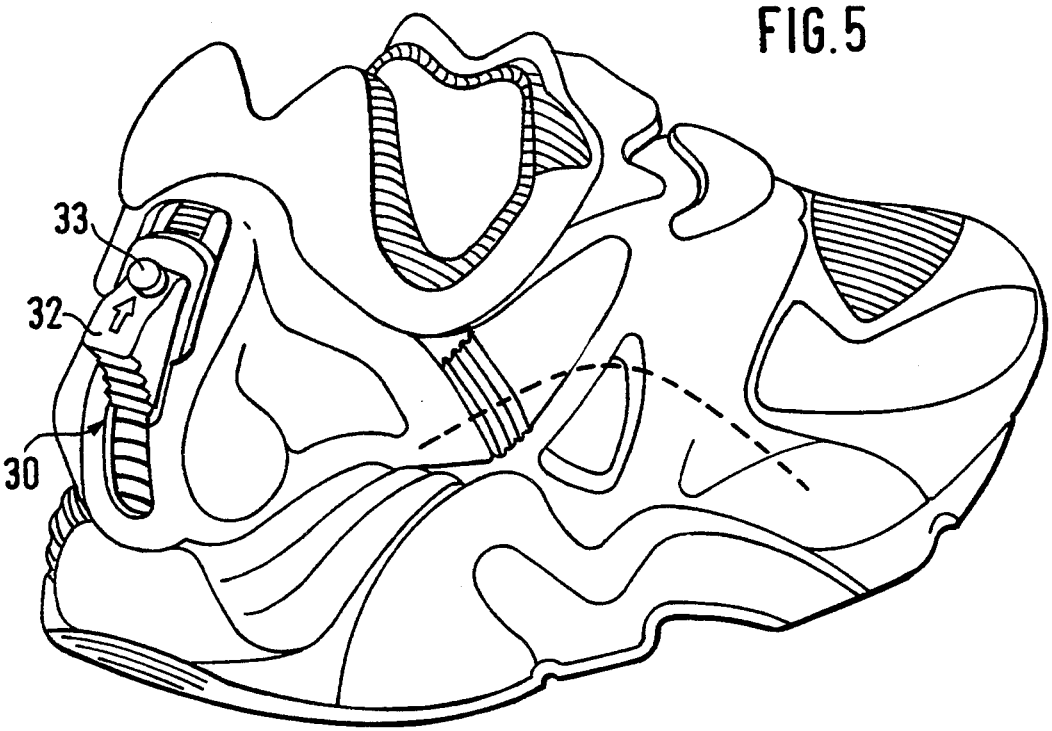

Central sliding closure 30 represented in FIG. 5 has a push button 33 on slide part 32 for quick release of the ratchet slide mechanism.

Figure 6:
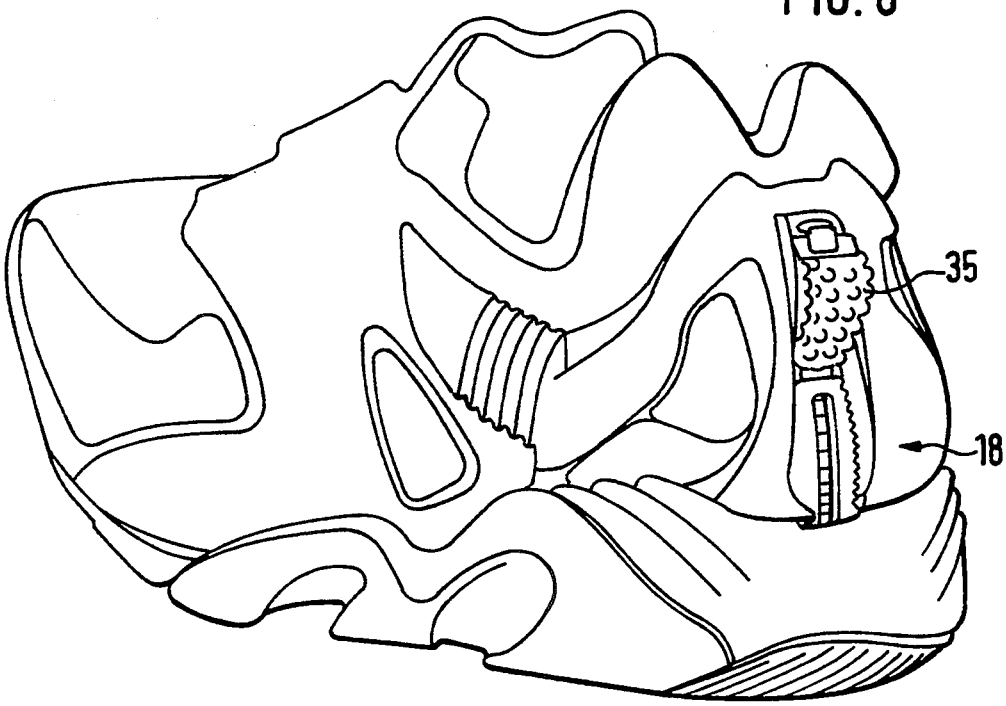

Finally, the central closure can also be designed as central lever closure 34, as is illustrated based on FIG. 6.

According to another embodiment, central sliding closure 30, represented in FIG. 4 and 5, can be designed to act like a lifting block.

The details of the central closure mechanisms, themselves, form no part of the present invention, and any known tightening mechanism can be used as the central closure so long as it can be made small enough to fit on the heel of the shoe and is able to wind up or pull in and releasably hold a sufficient extent of the wire- or rope-like tightening element(s) to secure the wearer's foot in the shoe.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

I claim:

1. A shoe of the type having a sole and an upper formed of nonrigid materials attached to the sole at a feather edge, and with a central closure mechanism that is coupled with at least one elongated flexible tightening element by which a vamp of the upper can be tightened and loosened via increasing and decreasing an effective length of the at least one tightening element as measured from the central closure mechanism, the at least one tightening element being guided from the central closure mechanism along sides of the shoe so as to pass from the upper to an instep cover that at least partially overlaps an instep area of the shoe and back to the upper, wherein:

A) said upper has a closed vamp that, at least in the instep area, is made of a volume-elastic compressible material;

B) the instep cover is made of an elastically bendable material at least approximately matched to a surface contour of the instep area;

C) said central closure mechanism is provided externally on a rear end of the upper above a heel of the shoe; and D) at least a section of the at least one tightening element runs at each side of the shoe, without crossing over the instep area, from the central closure mechanism to a guide element provided, at the feather edge on a heel curve to a higher guide element provided on the instep cover and then to a respective point, lying at the insole height, which is located in a small toe area at a lateral side of the shoe and which point is located in an area between a wearer's metatarsophalangeal joint of the big toe and approximately the center of an arch at a medial side of the shoe in a manner enabling the instep cover to be pulled toward the sole of the shoe by the central closure mechanism.

2. Shoe according to claim 1, wherein a heel cap is provided on a heel area of the upper; and wherein said guide element provided on the heel curve at the feather edge is provided on said heel cap at each side of the shoe.

3. Shoe according to claim 2, wherein the respective point, lying at the feather edge, which is located in the small toe area at the lateral side of the shoe and which point is located in the area between the wearer's metatarsophalangeal joint of the big toe and approximately the center of the arch at the medial side of the shoe is provided, in each case, by a forward guide element having a strap portion running parallel to the sole and an upstanding section extending along the upper from the strap portion.

4. Shoe according to claim 3, wherein the at least one tightening element attached to said upstanding section.

5. Shoe according to claim 3, wherein the at least one tightening element is guided and deflected by each forward guide element.

6. Shoe according to claim 5, wherein the at least one tightening element runs from the outside of the upper at said upstanding section of each forward guide element to inside of the shoe at the sole of the shoe.

7. Shoe according to claim 6, wherein said at least one tightening element runs between an insole and the sole.

8. Shoe according to claim 1, wherein said guide elements are provided with at least one of guide grooves and guide openings for the at least one tightening element.

9. Shoe according to claim 2, wherein the heel cap has one of an inwardly projecting flange and flange sections running parallel to the sole.

10. Shoe according to claim 3, wherein the strap portion of forward guide elements and one of a flange and flange sections of heel cap are embedded between the sole and the insole.

11. Shoe according to claim 3, wherein heel cap and the forward guide elements are formed as a single component with the sole.

12. Shoe according to claim 1, wherein the instep cover has at least one lateral reinforcing element running crosswise to a longitudinal axis of the shoe.

13. Shoe according to claim 1, wherein the instep cover has at least one opening therein.

14. Shoe according to claim 1, wherein the central closure mechanism comprises a rotary closure.

15. Shoe according to claim 1, wherein the central closure mechanism comprises a sliding closure.

16. Shoe according to claim 1, wherein the central closure mechanism comprises lever closure.

17. Shoe according to claim 1, wherein the central closure is provided with a quick release.

18. Shoe according to claim 1, wherein the respective point, lying at the feather edge, which is located in the small toe area at the lateral side of the shoe and which point is located in the area between the wearer's metatarsophalangeal joint of the big toe and approximately the center of the arch at the medial side of the shoe is provided, in each case, by a forward guide element having a strap portion running parallel to the sole and an upstanding section extending along the upper from the strap portion.

19. Shoe according to claim 10, wherein the at least one tightening element is a single tightening element which runs from the closure mechanism along the outside of the upper at one side there, at said upstanding section of one of the forward guide elements passes to inside of the shoe at the sole of the shoe, then travel across the shoe to the forward guide element on the other side of the shoe after which it travels back toward the central closure mechanism along the outside of the upper.

20. Shoe according to claim 19, wherein the tightening element runs between an insole and the sole as it travels across the shoe.

* * * * *